US005490828A

United States Patent [19]

Derby

[11] Patent Number: 5,490,828

[45] Date of Patent: Feb. 13, 1996

[54] BULK CONTAINER AND PROCESS FOR MANUFACTURE OF SAME

[75] Inventor: Norwin C. Derby, Sherman, Tex.

[73] Assignee: Super Sack Manufacturing Corp., Dallas, Tex.

[21] Appl. No.: 160,229

[22] Filed: Dec. 2, 1993

[51] Int. Cl.[6] ..... B31B 47/00; B31B 1/62; B31B 49/04

[52] U.S. Cl. ..... 493/220; 493/210; 493/267

[58] Field of Search ..... 493/84, 87, 102, 493/186, 210, 212, 213, 220, 183, 227, 231, 243, 252, 253, 260, 261, 267, 105, 106–108, 926, 967, 226; 112/121.15

[56] References Cited

U.S. PATENT DOCUMENTS

| | | | |
|---|---|---|---|
| 2,221,617 | 11/1940 | Steen . | |
| 2,929,544 | 3/1960 | Herschler . | |
| 4,143,796 | 3/1979 | Williamson et al. | 222/185 |
| 4,194,652 | 3/1980 | Williamson et al. | 222/185 |
| 4,457,456 | 7/1984 | Derby et al. | 222/105 |
| 4,759,473 | 7/1988 | Derby et al. | 222/105 |
| 4,903,859 | 2/1990 | Derby et al. | 220/462 |

OTHER PUBLICATIONS

"Get The Operator Out From Under The Bag With the New Remote Opening Discharge Spout (R.O.D.S.™*) Super Sack® Container", Super Sack Containers Technical Bulletin, Bulletin No. 60201.

"Super Sack® Woven Polypropylene Flexible Semi–Bulk Container For Shipping/Handling/Storing Dry–Flowable, Semi–Bulk, Materials, The Real Bag That Will Stand Up!", Super Sack Containers Technical Bulletin, Bulletin No. 871101.

*Primary Examiner*—Bruce M. Kisliuk
*Assistant Examiner*—Christopher W. Day
*Attorney, Agent, or Firm*—Michael A. O'Neil

[57] ABSTRACT

A process for the construction of a bulk container including a glued bottom portion. A blank is suspended in the shape of the desired container and is positioned over a bottom portion. Adhesive or glue is applied to the bottom portion in areas which will contact the blank. The blank is lowered into contact with the blank and fins are formed. The fins are either folded, cut and/or secured to complete the container in one of several ways.

6 Claims, 4 Drawing Sheets

BULK CONTAINER AND PROCESS FOR MANUFACTURE OF SAME

TECHNICAL FIELD

This invention relates to bulk containers and, more particularly, to bulk containers having a glued bottom and process for manufacturing the same.

BACKGROUND OF THE INVENTION

Historically, flexible bulk containers have been used for receiving, storing, transporting and discharging flowable materials of all types. The containers are typically constructed in a square, vertically rectangular or circular shape with lift straps attached to each of the uppermost corners of the square, rectangle or circle.

There has been an increasing interest of late in the use of flexible, collapsible containers for handling granular, liquid or powder (flowable) materials such as chemicals, minerals, fertilizers, foodstuffs, grains and agricultural products. The advantages of such receptacles include relatively low weight, reduced cost, versatility and, in the case of reusable receptacles, low return freight costs.

Typically, such containers are constructed by stitching or sewing together two or more sidewalls and a bottom portion. Optionally, a top portion, lift straps or other structural support can be added to this basic construction. The traditional method of securing the seams of the several portions of the container includes sewing or stitching, a time-consuming, labor-intensive and therefore expensive process. Usually, attachment of the bottom portion to the remaining piece or pieces, a critical step in the manufacture of a container, consumes the most time, labor and expense.

Thus a need has arisen for a method of construction of a container wherein the bottom panel is quickly, easily and inexpensively attached to the container.

SUMMARY OF THE INVENTION

The instant invention overcomes the foregoing and other problems associated with the prior art by providing a method of construction of a container wherein the bottom portion of the container is quickly, easily and inexpensively secured to the container.

According to the instant invention, a blank is constructed by securing one or more sidewalls together to form a container lacking a top and a bottom. For purposes of this application, the term "blank" will be used to refer to containers lacking a top portion and a bottom portion and constructed from either a single sheet of material or any number of sidewalls secured together. Next, the blank is attached to a carriage and suspended over a work table by a structural support. The structural support includes a raised work platform designed to place a worker in an optimum position for attaching the bottom portion to the blank to form a container. From the raised work platform, a worker can secure the blank to the carriage, position the blank over the work table and perform the steps necessary to secure the bottom portion to the blank to form a container. The work table includes a hole at its center so that a fill-spout, if any, of the bottom portion can be accommodated during the construction process.

Since the blank lacks a top portion and a bottom portion at this stage in the construction, the carriage of the structural support includes outwardly-movable support arms capable of supporting the blank by stretching the flexible material of the blank into the shape of a square or rectangle. The opposing force of the support arms at the four sides of the blank simultaneously supports the blank and shapes the blank for receiving the bottom portion.

In the next step of the instant invention, a bottom portion is positioned on the work table beneath the suspended blank. Adhesive or glue is then applied to the bottom portion in areas which will come into contact with the blank.

Subsequent to placement of the adhesive or glue, the blank is lowered into contact with the bottom portion. The length of the blank is then draped down and over the work table so that the portions of the blank contacting the adhesive or glue on the bottom portion are accessible to the worker. Fins of the blank material are formed where the corner of the blank is in contact with the bottom portion. In the final steps of the construction process of the present invention, the fins are, folded, cut and/or secured to the bottom portion by one or more of several methods. Once the fins are secured, the container is formed and is ready for the attachment of optional features such as lift straps or a top portion.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1:
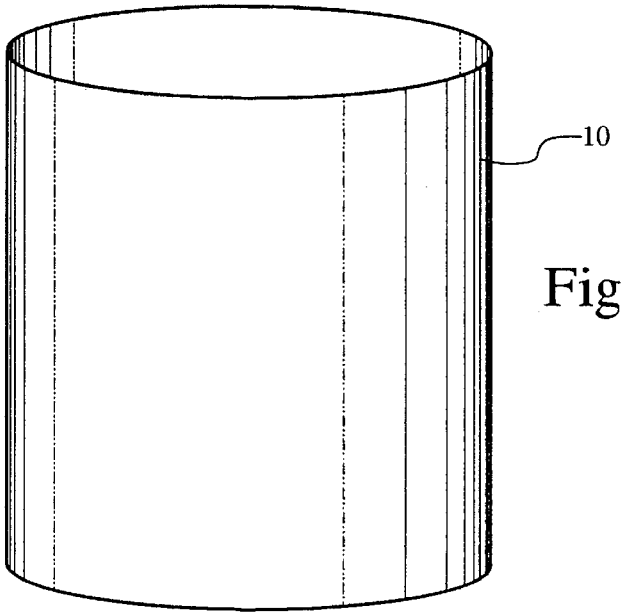
FIG. 1 is a perspective view of a blank.

Referring now to FIG. 1, there is shown a blank associated with the container construction method of the present invention.

A blank 10 is constructed from either a single piece of flexible material or from several sidewalls of such material. If more than a single piece of material is used, the pieces are secured together by any of a number of traditional methods, such as stitching or sewing.

Figure 2:
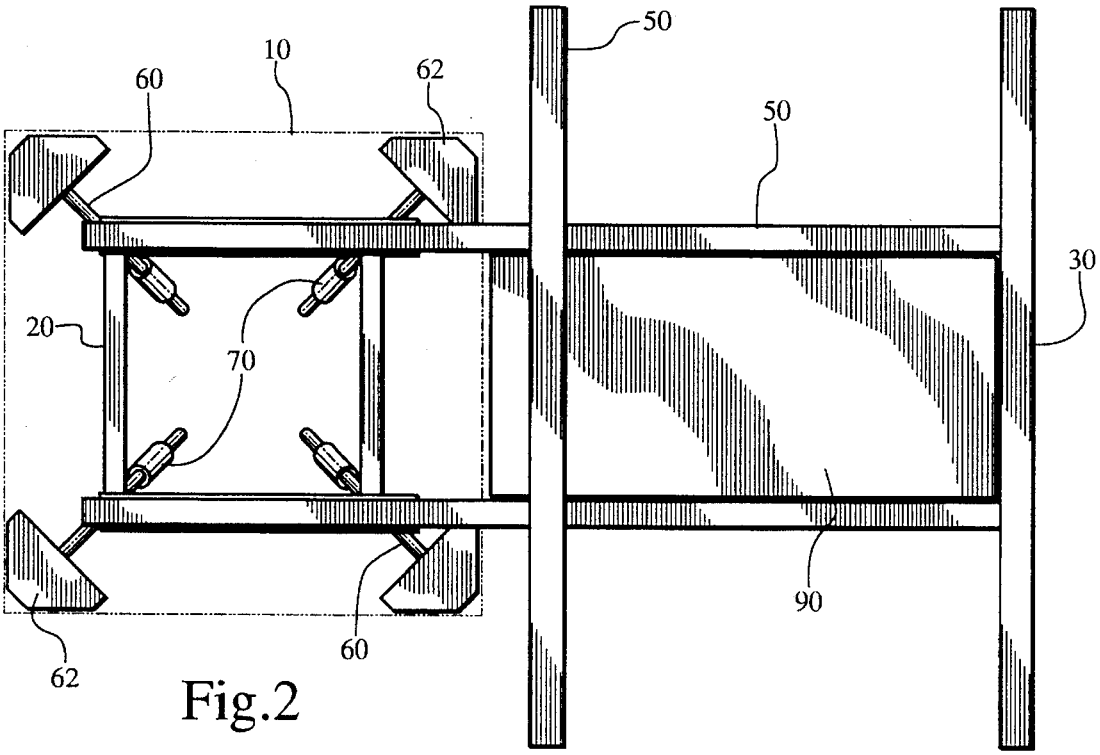
FIG. 2 is a top view, showing the support structure and carriage used in the process of manufacturing the invention.
Figure 3:
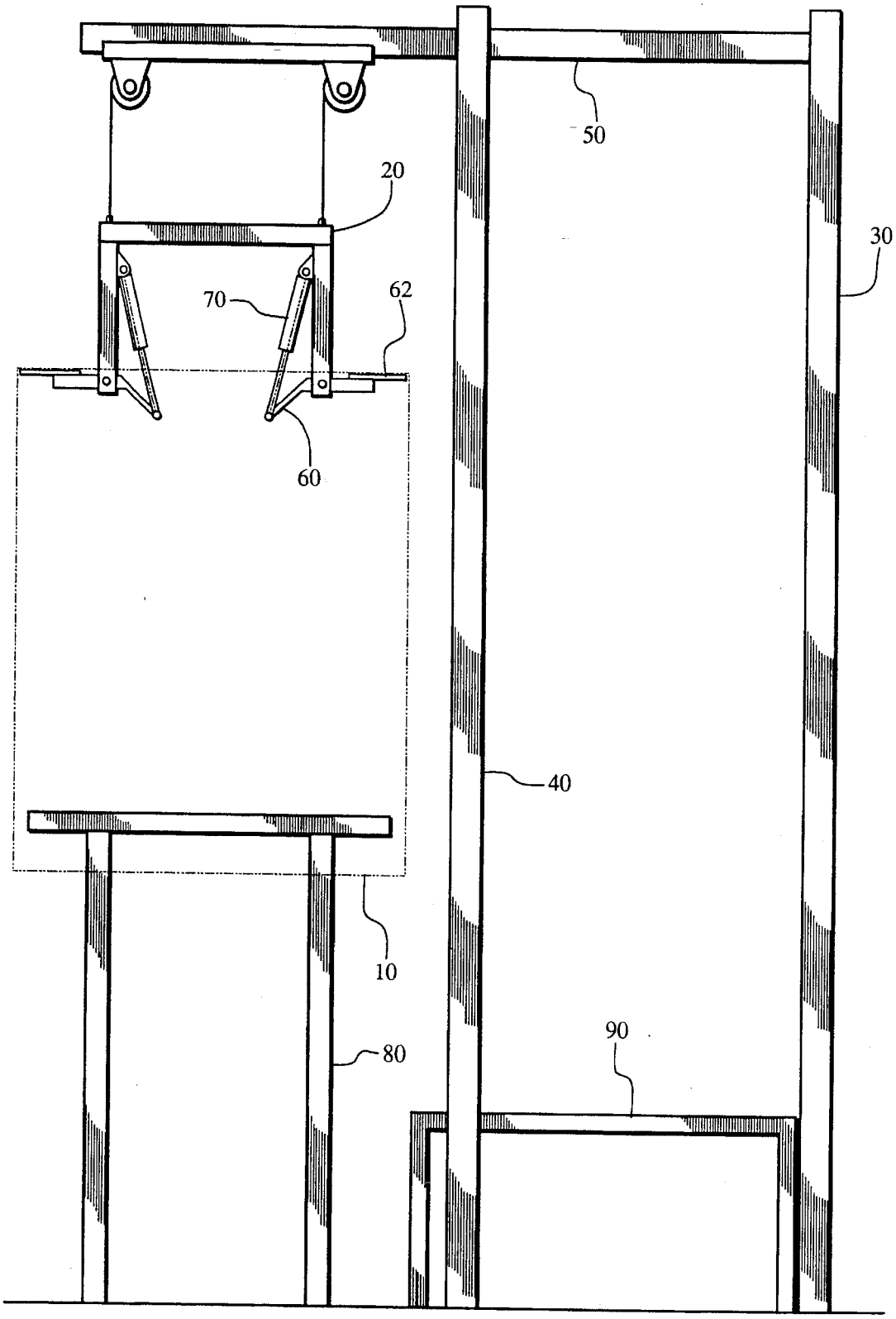
FIG. 3 is a side view, showing the support structure and carriage used in the manufacture of the invention.

Referring to FIG. 2 and 3, once the blank 10 is formed, it is attached to a carriage 20 of a structural support 30. The structural support 30 is formed of wood, steel or other suitable materials to provide support to the blank during the instant construction process and to provide optimum placement of the worker in charge of performing the instant construction process. The structural support comprises one or more vertical support members 40 and one or more horizontal support members 50. Attached to one or more of the horizontal support members is the carriage 20. The carriage 20 includes outwardly-movable support arms 60 shaped at their tips 62 to form corners in the blank when extended. In an embodiment of the invention, four support arms 60 are used to form the shape of a square or rectangle. Other embodiments utilize more or less support arms 60 to form other shapes. For example, by using three support arms 60, a triangular shape would be imparted to the blank. FIG. 2 is a top view of the structural support 30 demonstrating a blank 10 being held by the support arms 60 in a square shape.

Referring again to FIG. 3, the blank 10 is attached to the carriage 20 by placing the top end of the blank 10 around, and extending, the support arms 60. The support arms 60 are automatically extended by spring-loaded or hydraulic means 70. Once attached the carriage is positioned by the worker over a raised work table 80 for the remaining steps of the construction process. The work table 80 is raised to facilitate later steps in the construction process where the length of the blank 10 is released from the carriage 20 and is draped over the work table 80. A hole 82 (FIG. 4) is included in the surface of the work table 80 to accommodate a fill-spout, if any, on the bottom portion of the container. Beneath the structural support 30 and aligned with the work table 80 is a raised platform 90 for a worker (not shown). Standing on the platform 90, a worker can quickly and easily attach the blank 10 to the carriage 20 and position the blank 10 over the work table 80.

Figure 4:
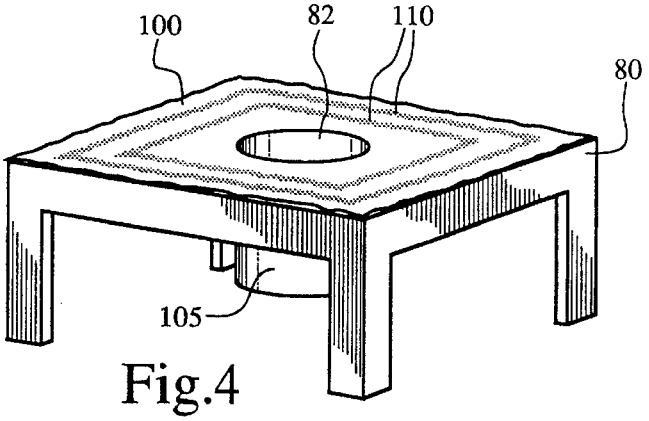
FIG. 4 is a partial perspective view of the work table of the support structure.
Figure 5:
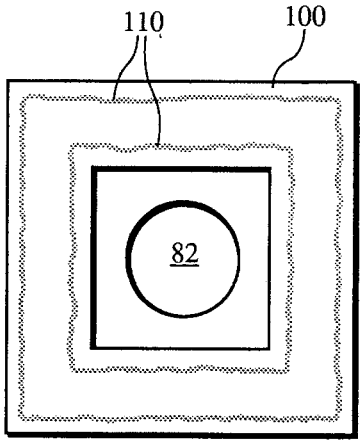
FIG. 5 is a top view, showing a glue pattern on the bottom portion of a bag.

Referring now to FIG. 4, once the blank 10 is suspended over the work table 80, a bottom portion 100 is positioned on the surface of the work table 80. The hole 82 in the surface of the work table 80 accommodates a fill-spout 105, if any, in the bottom portion 100. Next, as shown in FIG. 5, an adhesive or glue 110 is applied to the upper surface of the bottom portion 100. Although the adhesive or glue 110 is shown to be applied in a generally square pattern along the periphery of the bottom portion 100, any pattern of application can be used, if desired.

Figure 6:
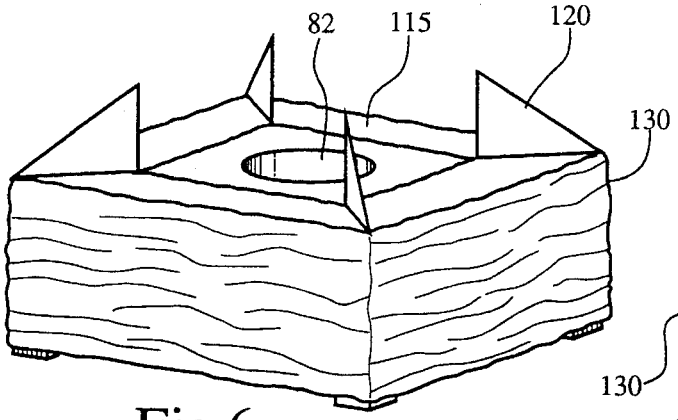
FIG. 6 is a perspective view, showing the circular blank secured to the bottom portion and the fins of the blank.

Now referring to FIG. 6, in the next step of the instant construction process, the blank 10 is lowered into contact with the bottom portion 100 resting on the work table 80. The blank 10 is then disconnected from the carriage 20, allowing the remaining length of the blank 10 to drape over the work table 80, revealing the inner surface 115 of the blank 10. Fins 120 are formed at the corners where the blank 10 meets and is attached to the bottom portion 100. These fins 120 can be folded, cut and/or secured to complete the container 130 by one or more of the methods illustrated in FIGS. 7, 8 and 9. The corners of the fins can be pre-sewn to provide additional support. This latter option is particularly helpful in applications where the bag will be subjected to elevated temperatures which might cause adhesives and/or glues to soften.

Figure 7:
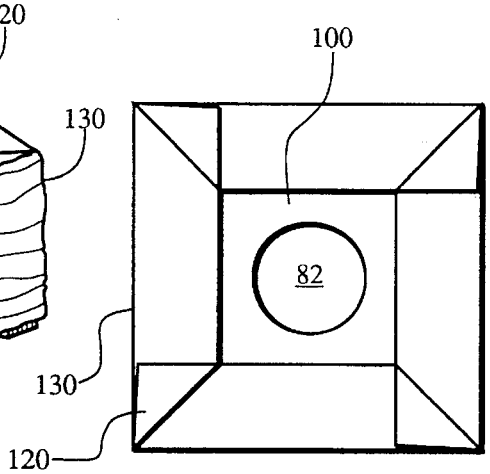
FIGS. 7 through 9 are top views and demonstrate some of the several ways in which the fins of the blank can be folded and secured.
Figure 8:
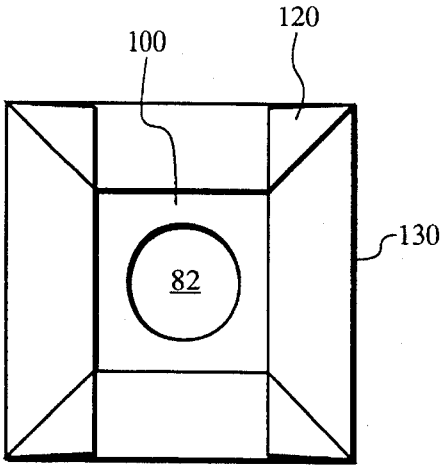
Figure 9:
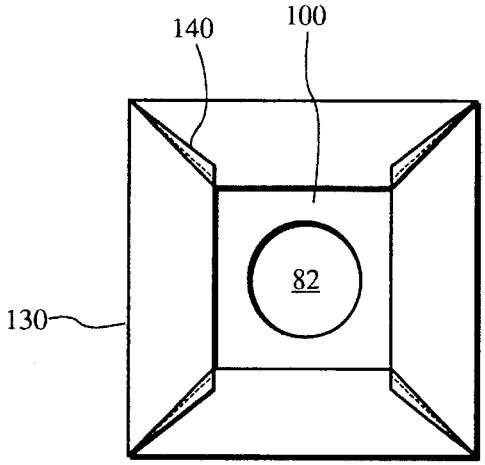

In FIGS. 7 through 9, the fins 120 are folded in different directions and secured with adhesive or glue (not shown) to the material of the container 130. In FIG. 9, the fins 120 are cut away from the container 130. The seams 140 are then secured to the container 130 using any suitable method of securement, including stitching, sewing and/or gluing.

Figure 10:
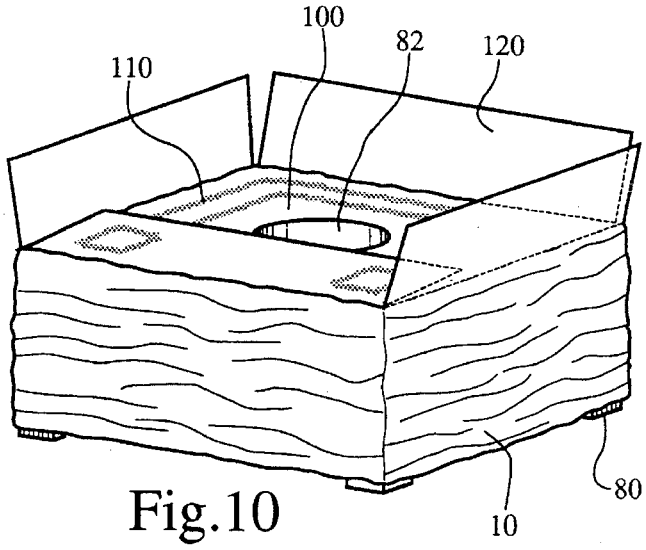
FIGS. 10 and 11 are a perspective view and a top view, respectively, showing a different method of securing the fins of the blank.
Figure 11:
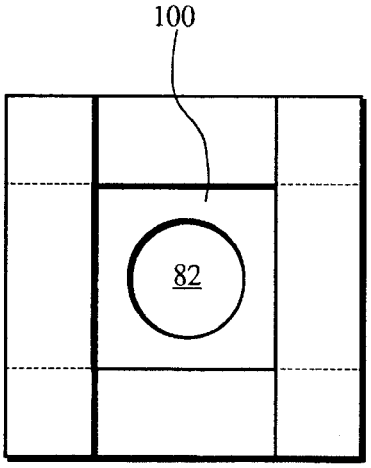
Figure 12:
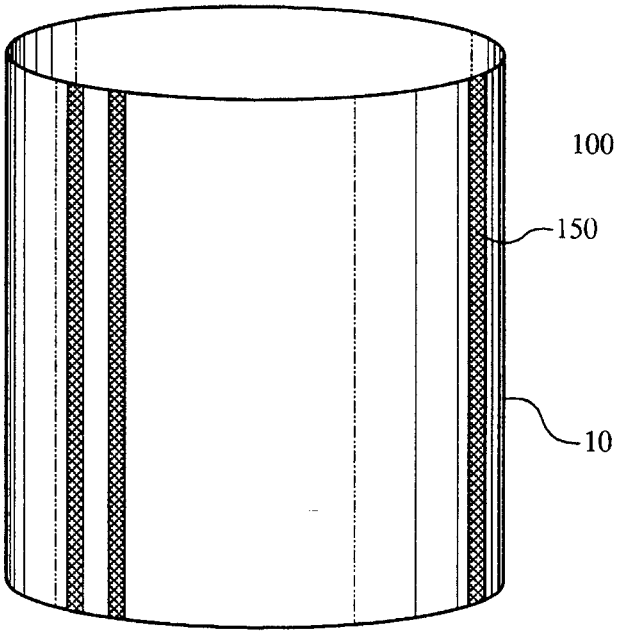
FIGS. 12 and 13 are a perspective view and a top view, respectively, showing a blank having re-enforced sidewalls and a method of folding and securing the fins of the blank.
Figure 13:
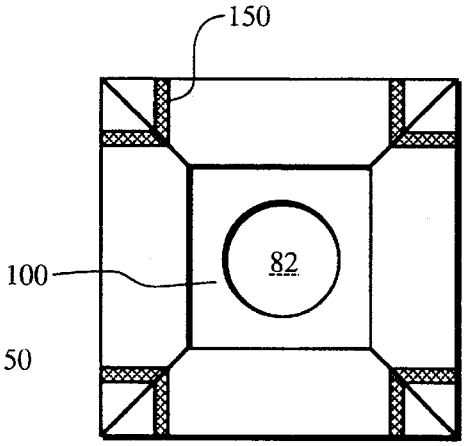

In FIGS. 10 and 11, an alternative step of folding and securing the fins 120 is illustrated. In this embodiment, the fins are cut at the seams 140 and are folded over each other and secured to the container 130. Finally, FIGS. 12 and 13 illustrate a blank and container, respectively, including reenforced seams 150. As is demonstrated, these types of blanks can be formed into containers much like the other embodiments discussed above.

Only the preferred embodiments of the invention have been described. It should be understood that the invention is not limited to the embodiments disclosed, but is intended to embrace any alternative, modifications, rearrangemerits, or substitutes of parts or elements as fall within the spirit and scope of the invention.

I claim:

1. A method of manufacturing a flexible bulk container having a sidewall and bottom wall, said method comprising the steps of:

(a) supplying a sidewall blank having a substantially hollow tubular configuration, said sidewall blank having an upper portion and a lower portion and an inside and an outside;

(b) supplying a bottom wall of predetermined horizontal cross-sectional size and shape;

(c) placing the bottom wall on a raised work area;

(d) applying adhesive to the bottom wall;

(e) positioning the sidewall blank over the raised work area and lowering the sidewall blank such that the lower portion of the sidewall blank is located below the work area and the upper portion is located above the work area; and (f) subsequent to steps (a) through (e), securing the sidewall blank to the bottom wall by folding the upper portion of the sidewall blank over the bottom wall, such that the inside of the blank contacts the adhesive located on the bottom wall.

2. The method of manufacturing a flexible bulk container of claim 1 wherein said method further includes:

the raised work area having a horizontal cross-sectional size and shape substantially the same as the cross-sectional size and shape of the bottom wall.

3. A method of manufacturing a flexible bulk container having a sidewall and bottom wall, said method comprising the steps of:

(a) supplying a sidewall blank having a substantially hollow tubular configuration, said sidewall blank having an upper portion and a lower portion and an inside and an outside;

(b) supplying a bottom wall of predetermined horizontal cross-sectional size and shape;

(c) placing the bottom wall on a raised work area;

(d) applying adhesive to the bottom wall;

(e) positioning the sidewall blank over the raised work area and lowering the sidewall blank such that the lower portion of the sidewall blank is located below the work area and the upper portion is located above the work area; and (f) forming corners and fins from the upper portion of the sidewall blank;

(d) securing the sidewall blank to the bottom wall by folding the upper portion of the sidewall blank over the bottom wall, such that the inside of the blank contacts the adhesive on the bottom wall; and (h) securing the fins to the outside of the folded over lower portion of the sidewall blank.

4. The method of manufacturing a flexible bulk container of claim 3 wherein said method further includes pre-sewing the fins prior to securing the sidewall blank to the bottom wall.

5. A method of manufacturing a flexible bulk container having a sidewall and bottom wall, said method comprising the steps of:

(a) supplying a sidewall blank having a substantially hollow tubular configuration, said sidewall blank having an upper portion and a lower portion and an inside and an outside;

(b) supplying a bottom wall of predetermined horizontal cross-sectional size and shape;

(c) placing the bottom wall on a raised work area;

(d) applying a first component of an adhesive to the outside of the bottom wall and applying a second component of an adhesive to the inside of the upper portion of the sidewall blank;

(e) positioning the sidewall blank over the raised work area and lowering the sidewall blank such that the lower portion of the sidewall blank is located below the work area and the upper portion is located above the work area; and (f) subsequent to steps (a) through (e), securing the sidewall blank to the bottom wall by folding the upper portion of the sidewall blank over the bottom wall, such that said second component of adhesive on the inside of the sidewall blank contacts said first component of adhesive on the outside of the bottom wall.

6. A method of manufacturing a flexible bulk container having a sidewall and bottom wall, said method comprising the steps of:

(a) supplying a sidewall blank having a substantially hollow tubular configuration, said sidewall blank having an upper portion and a lower portion and an inside and an outside;

(b) supplying a bottom wall of predetermined horizontal cross-sectional size and shape;

(c) placing the bottom wall on a raised work area;

(d) applying adhesive to the bottom wall;

(e) suspending the sidewall blank over the raised work area using a movable carriage;

(f) shaping the sidewall blank into a horizontal cross-sectional size and shape substantially the same as the bottom wall using outwardly movable support arms mounted on the movable carriage;

(g) positioning the suspended sidewall blank over the raised work area and lowering the sidewall blank such that the lower portion of the sidewall blank is located below the work area and the upper portion is located above the work area; and (f) subsequent to steps (a) through (g), securing the sidewall blank to the bottom wall by folding the upper portion of the sidewall blank over the bottom wall, such that the inside of the blank contacts the adhesive located on the outside of the bottom wall.

* * * * *

UNITED STATES PATENT AND TRADEMARK OFFICE

CERTIFICATE OF CORRECTION

PATENT NO. : 5,490,828

DATED : February 13,1996

INVENTOR(S) : Norwin C. Derby

It is certified that error appears in the above-indentified patent and that said Letters Patent is hereby corrected as shown below:

On the Title Page:

[56] References Cited--

Add the following U. S. Patent Documents:

| | | | |
|---|---|---|---|
| 4,221,250 | 09/1980 | Manerba | 493/212 |
| 4,365,459 | 12/1982 | Grundler | 493/252 |
| 4,493,109 | 01/1985 | Nattrass | 493/926 |
| 4,479,243 | 10/1984 | Derby et al | 493/210 |
| 4,927,075 | 05/1990 | Lisiecki | 493/183 |
| 5,110,037 | 05/1992 | Pieritz, Sr. | 493/183 |
| 5,230,689 | 07/1993 | Derby | 493/210 |
| 5,244,280 | 09/1993 | Porter et al | 493/226 |
| 5,127,893 | 07/1992 | LaFleur | 493/226 |
| 4,664,044 | 05/1987 | Gazzarrini | 112/121.15 |
| 4,133,280 | 01/1979 | Takatori et al | 112/121.15 |

Add the following Foreign Patent Documents:

| | | |
|---|---|---|
| 1,385,286 | 02/1975 | Great Britain |
| 2457533 | 08/1975 | W. Germany |

Signed and Sealed this

Fifteenth Day of April, 1997

*Attest:*

*Attesting Officer*

BRUCE LEHMAN

*Commissioner of Patents and Trademarks*